United States Patent [19]

Hamrick

[11] 4,142,643

[45] Mar. 6, 1979

[54] BOTTLE CASE UNLOADER

[75] Inventor: Gene H. Hamrick, Tallmadge, Ohio

[73] Assignee: Hamrick Manufacturing & Service, Inc., Mogadore, Ohio

[21] Appl. No.: 822,680

[22] Filed: Aug. 8, 1977

[51] Int. Cl.[2] ..... B65B 21/18

[52] U.S. Cl. ..... 414/416; 198/627; 414/266

[58] Field of Search ..... 198/817, 626, 627; 214/1 R, 1 BA, 1 B, 309

[56] References Cited

U.S. PATENT DOCUMENTS

| | | | |
|---|---|---|---|
| 2,758,731 | 8/1956 | Davis | 214/309 |
| 3,289,867 | 12/1966 | Burke | 214/309 |
| 3,570,693 | 3/1971 | Peyton | 214/309 |
| 3,951,285 | 4/1976 | Barker | 214/309 |

*Primary Examiner*—Frank E. Werner

*Attorney, Agent, or Firm*—Hamilton, Renner & Kenner

[57] ABSTRACT

A case unloader for removing empty beverage bottles from cases and delivering them to a conveyor conducting the bottles to a bottle washer prior to recycling. Each longitudinal row of bottles has its own individual arm or plate on which opposed V-belts are mounted for gripping the bottle necks, and the arms are adjustable vertically and laterally to accommodate different bottle heights and different lateral spacings of the bottle necks of different sizes of bottles. The lateral spacing of each pair of V-belts is adjustable to accommodate different sizes or shapes of bottle necks.

10 Claims, 6 Drawing Figures

BOTTLE CASE UNLOADER

BACKGROUND OF THE INVENTION

Certain prior apparatuses for unloading bottle cases have been complicated and expensive. Moreover, in certain constructions the bottle gripping means have all been mounted on a unitary head, necessitating use of different heads for different lateral spacings of the necks of the bottles in the cases and for different sizes or shapes of bottle necks which involved the expense of keeping several heads available, as well as time and labor to change over.

SUMMARY OF THE INVENTION

It is an object of the present invention to provide a simple and inexpensive bottle case unloader having individual arms carrying opposed V-belts for gripping each longitudinal row of bottles.

Another object is to provide improved means for adjusting the lateral spacing of the arms to accommodate different lateral spacings of the bottle necks.

Another object is to provide improved means on each arm for adjusting the lateral spacing of the opposed V-belts to accommodate bottle necks of different sizes and shapes.

A further object is to provide improved means for simultaneously adjusting all of the arms vertically to accommodate bottles of different heights.

DESCRIPTION OF A PREFERRED EMBODIMENT

Figure 1:
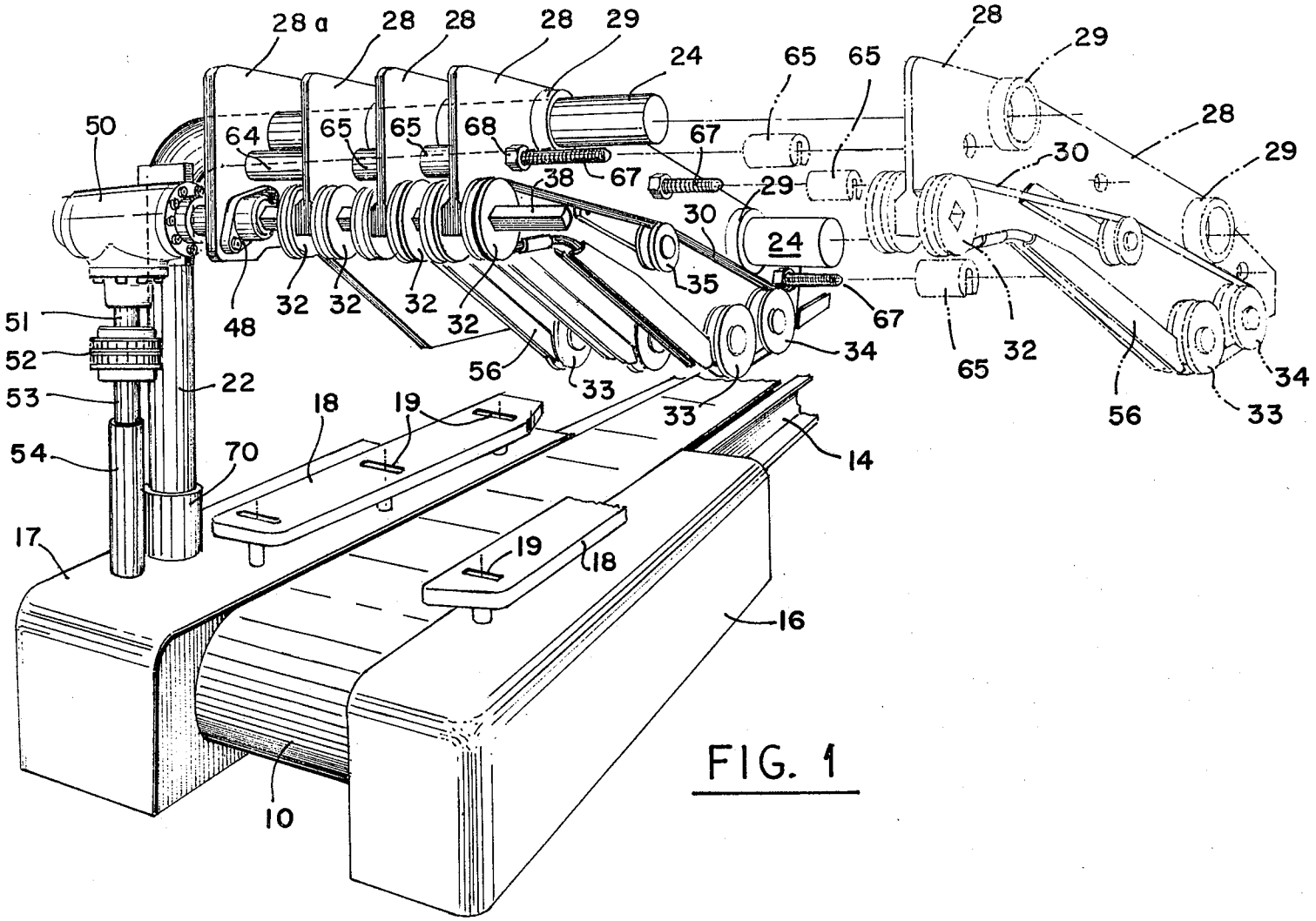
FIG. 1 is a perspective view of the improved bottle case unloader, partly broken away, showing an additional belt-carrying arm in exploded position in phantom lines.
Figure 2:
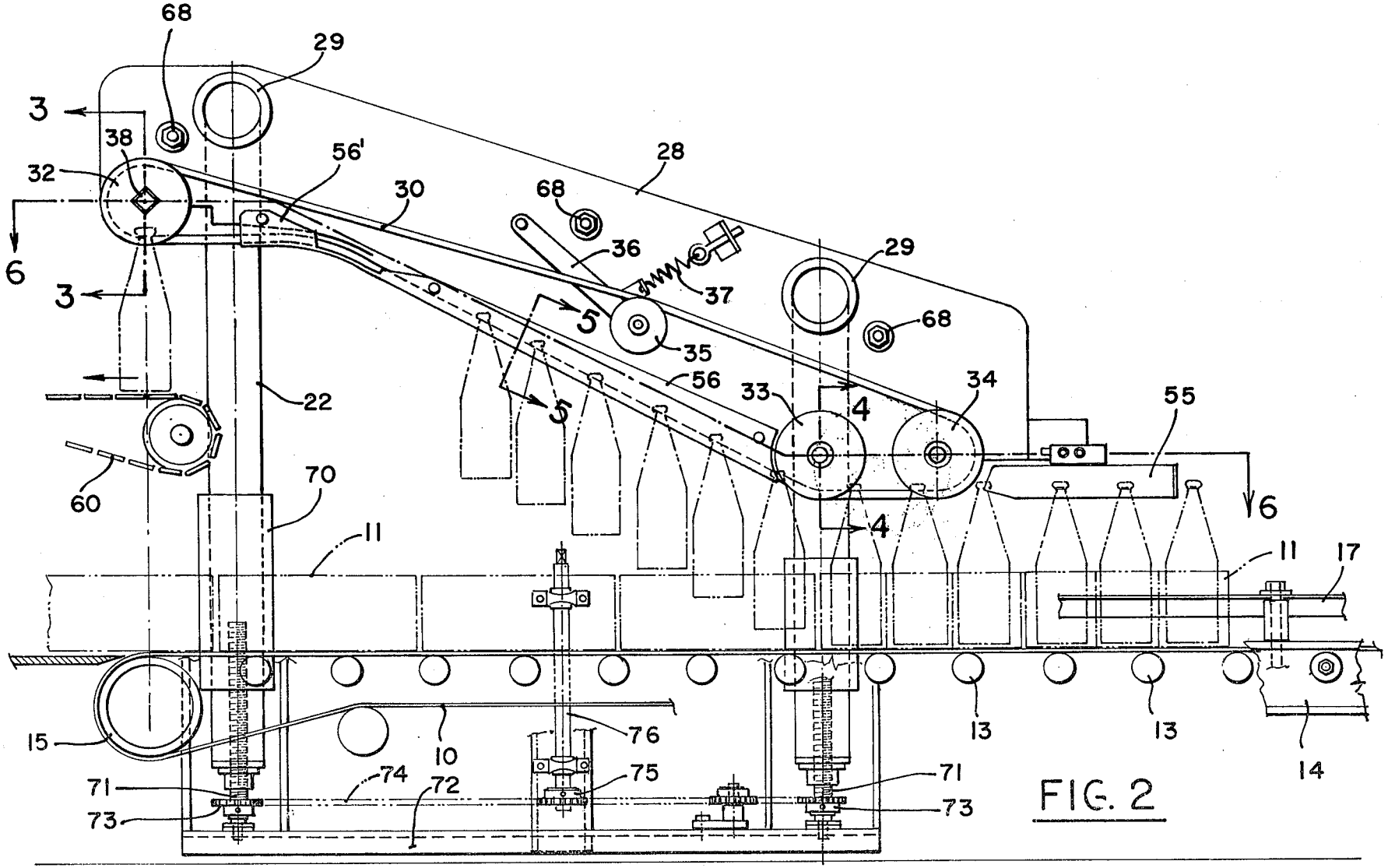
FIG. 2 is a side elevation showing bottles and cases in phantom lines.

Referring to FIGS. 1 and 2, a belt conveyor 10 is provided for conveying cases 11 of empty bottles 12 shown in phantom lines in FIG. 2. The belt is supported in a usual manner on a series of spaced rollers 13 journaled at their ends in channels 14 extending along the sides of the belt. The belt is preferably driven at the delivery end by a drive pulley 15, and housings 16 and 17 are provided extending along the sides of the belt enclosing the motor driving the drive pulley 15 and the channels 14, and other mechanism.

Longitudinal guide bars 18 are supported on the side channels 14 above the housing 16 and 17 and extend longitudinally alongside the belt 10. The inner edges of these bars are spaced apart a distance equal to the overall width of the cases 11 so as to slidably abut the cases traveling over the conveyor belt and keep them in longitudinal alignment, thus maintaining the longitudinal rows of empty bottles therein in longitudinal alignment.

As shown, the bars have lateral slots 19 for receiving supporting bolts 20 to allow lateral adjustment of the bars to accommodate variations in the widths of cases.

Two longitudinally spaced vertical supporting columns or posts 22 extend upwardly from within housing 17 and are supported at their lower ends in a manner to be described. At their upper ends the posts have elbow bends 23 connected to horizontal support shafts 24 extending laterally above the conveyor belt 10 and having their outer ends free and unsupported. Preferably, the posts are telescopically adjustable in a manner to be described to adjust the heights of the shafts 24.

The individual belt-carrying arms are indicated at 28 and comprise vertically disposed plates which are longitudinally aligned with the necks of the longitudinal rows of bottles in the cases. Three plates 28 are shown longitudinally aligned with the necks of three longitudinal rows of bottles 12. A fourth plate 28 is shown detached in phantom lines with spacers to be used when cases having four longitudinal rows of bottles are unloaded. Each of the plates 28 has two tubular bosses 29 spaced longitudinally to register with and slidably receive the support shafts 24.

Each plate 28 has V-belts 30 operatively mounted on opposite sides. Each belt is trained around a drive pulley 32 at one end of the plate and around two pulleys 33 and 34 journaled on the plate 28 near the opposite end. Preferably, the upper run of the belt is tensioned by an idler pulley 35 intermediate the pulleys 32 and 34. Pulley 35 is journaled on an arm 36 pivoted on the plate 28 and tensioned by a spring 37 connecting the arm 36 to the plate.

Figure 3:
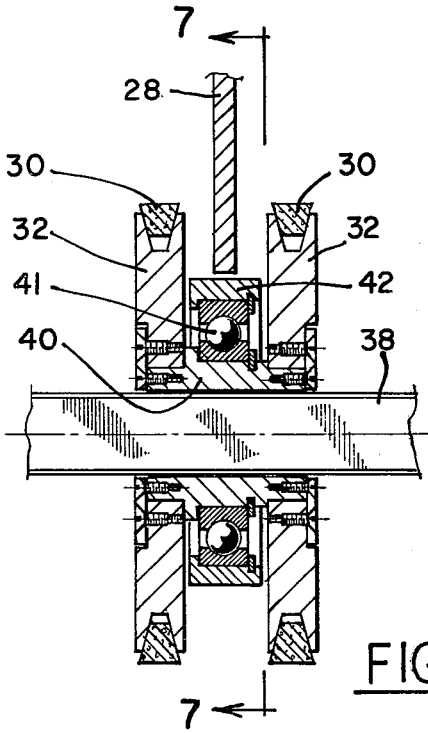
FIG. 3 is a partial sectional view on line 3—3 of FIG. 2.
Figure 7:
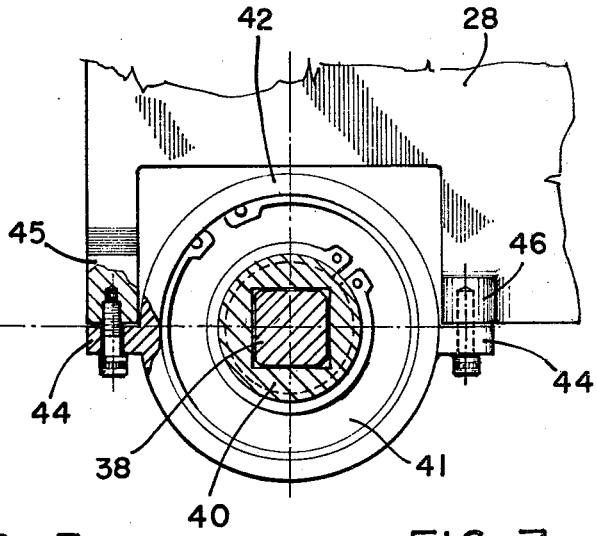
FIG. 7 is a partial sectional view on line 7—7 of FIG. 3.

The drive pulleys 32 are non-rotatably mounted on a square drive shaft 38 journaled in the ends of the plates 28. As seen in FIGS. 3 and 7, the pulleys 32 are secured on a bushing 40 which is slidably and non-rotatably mounted on the drive shaft 38, and the bushing forms the inner raceway for an anti-friction bearing 41. The outer raceway comprises a ring 42 fitting within a recess 43 in the plate 28 and having diametrically opposite lugs 44 secured to bosses 45 and 46 on the plate.

The drive shaft 38 extends through the plates 28 and through a suitable bearing 48 mounted on a positioning or reference plate 28*a* fixed on the support shafts 24 adjacent to the elbow bends 23. Beyond the plate 28*a* the shaft enters a gear box 50 in which the shaft is operatively connected to a vertical drive shaft 51 depending from the gear box. The shaft 51 is connected by a coupling 52 to a shaft 53 which is splined in a tubular shaft 54 extending into the housing 17 enclosing suitable power means for rotating the shaft 54. The power for rotating shaft 54 may be derived from the means driving the conveyor belt 10 or may be independent means. The splined connection provides for simultaneously vertically adjusting the height of the drive shaft 38 when the heights of the support shafts 24 and the plates 28 thereon are adjusted.

Figure 4:
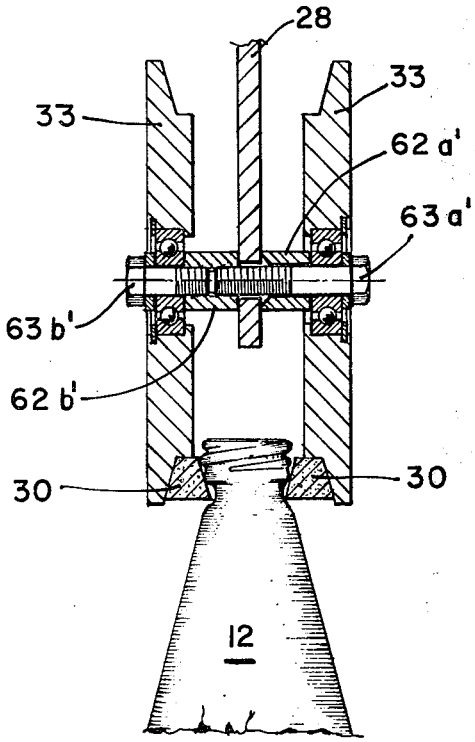
FIG. 4 is a partial sectional view on line 4—4 of FIG. 2.

As seen in FIG. 2, the heights of the plates 28 are positioned so that the lower horizontal runs of V-belts 30 between pulleys 33 and 34 straddle the longitudinal rows of bottle necks advancing on the conveyor belt 10. Preferably, a pair of laterally spaced vertical guide plates 55 is mounted on the lower front end of each arm 28 for longitudinally aligning each row of bottle necks approaching the V-belts 30. The inner flanges of the pulleys 33 are cut away to allow the belts to contact the bottle necks, as shown in FIG. 4. Between the pulleys 33 and 32 the upwardly inclined lower runs of the belts pass between pairs of guide flanges 56 mounted on the plate 28 and spaced apart the proper distance so that the belts are caused to rock or tilt laterally and engage the necked-in portions of the bottle necks under the beads, as shown in FIG. 5.

Figure 5:
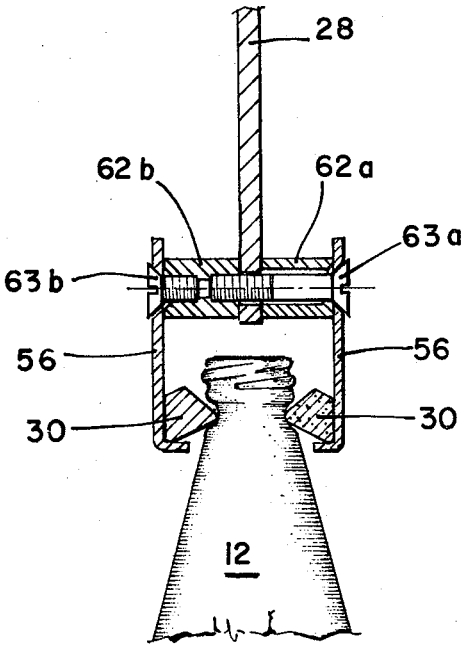
FIG. 5 is a partial sectional view on line 5—5 of FIG. 2.
Figure 6:
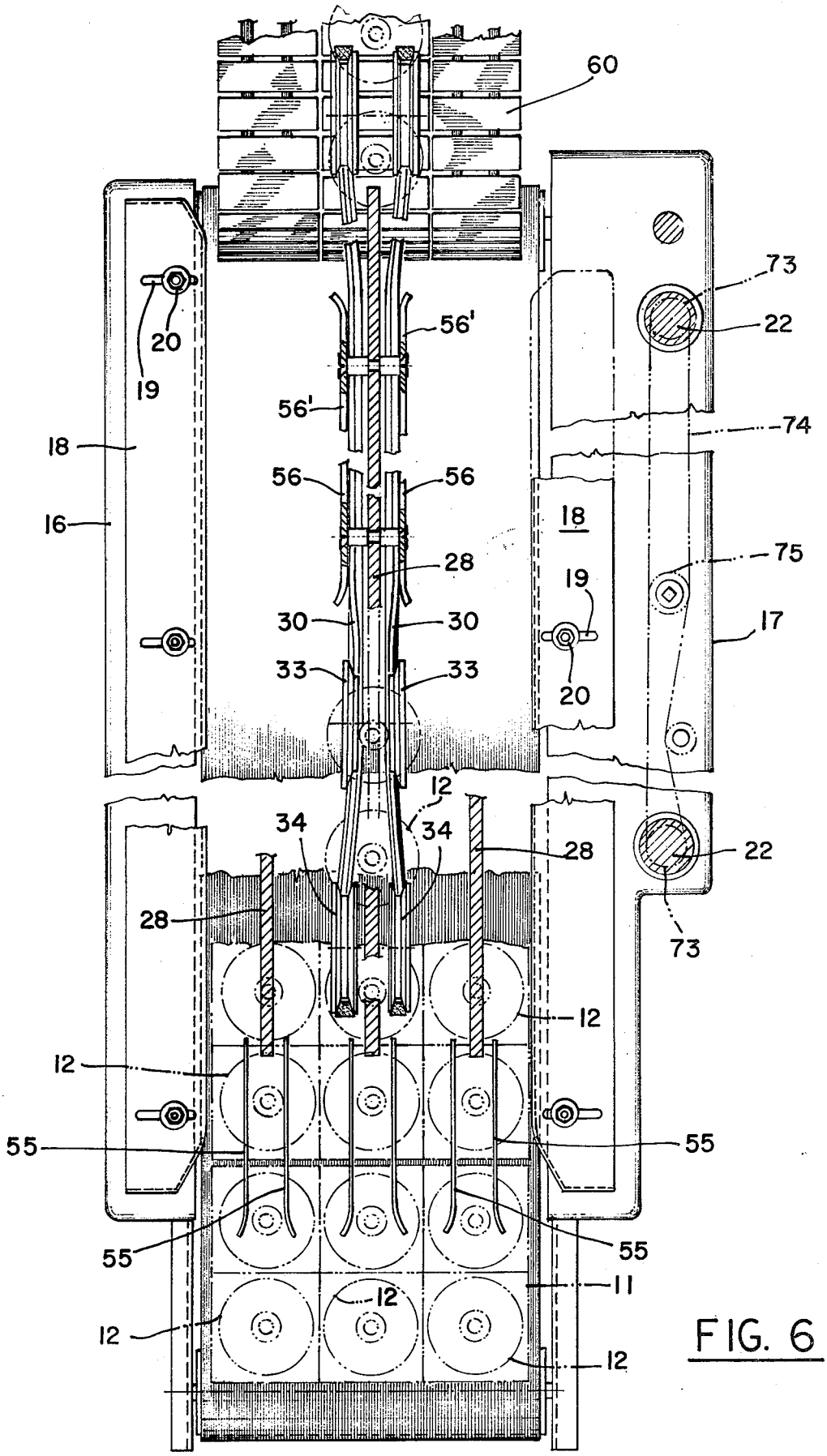
FIG. 6 is a somewhat schematic plan sectional view, partly broken away, on line 6—6 of FIG. 2.

As shown in FIG. 6, the spacing between the outer flanges of the pulleys 33 is slightly less than between the outer flanges of pulleys 34, so that the belts 30 close in around the necks of bottles passing through that location, and as the belts move up the incline and pass between the guide flanges 56 they are rocked laterally and pinched together still further, as in FIG. 5, so as to engage the necked-in portions of the bottle necks and carry the bottles up the incline. Between the guide flanges 56 and the pulleys 32 the belts pass between pairs of guide flanges 56'.

At the upper end of the incline, as the belts travel horizontally from the guide flanges 56' they flare apart slightly to enter the flanges of pulleys 32 which are spaced apart sufficiently to release the bottle necks and deposit the bottles on a conveyor 60 for delivery to a washer or the like for recycling.

Referring to FIGS. 4 and 5, the flanges of pulleys 33 and the guide flanges 56 and 56' are adjustable toward and away from each other for the purpose of accommodating the belts to different sizes and shapes of bottle necks. In FIG. 5, the guide flanges are shown spaced apart on opposite sides of the plate 28 by bushings **62*a* and 62*b* having a predetermined length adapted for one type of bottle neck. A screw 63*a* passes through bushing 62*a* and is screwed into the inner end of bushing 62*b* to clamp one plate 56 in place, and a screw 63*b* is screwed into the outer end of the bushing 62*b* to hold the other plate 56 in place. A similar arrangement is depicted in FIG. 4 using bushings 62*a'* and 62*b'* and bolts 63*a'* and 63*b'*, the shanks of the bolts journaling the bearings for the pulleys 33**.

It will be seen that the spacing of the flanges of pulleys 33 and guide flanges 56 can be easily adjusted by substituting bushings **62*a* and 62*b*, and 62*a'* and 62*b'*** of different predetermined lengths to accommodate bottle necks of different sizes and shapes.

The means for positioning and laterally adjusting the belt-carrying arms 28 to accommodate the lateral spacings of the longitudinal rows of different sizes of bottles in the cases will now be described.

As previously stated the positioning or reference plate **28*a* is fixed on the horizontal support shafts 24 and the plates 28 are slidably mounted on the shafts 24. In order to space the plates 28 at the required distances from plate 28*a* so as to be in alignment with different predetermined lateral spacings of bottle necks in the cases 11, C-shaped laterally removable spacer sleeves 64 of predetermined length are provided between positioning plate 28*a* and the next adjacent plate 28 and C-shaped spacer sleeves 65 of predetermined length are provided between the three plates 28. These spacer sleeves 64 and 65 are provided at three locations spaced longitudinally of the plates 28*a* and 28**.

At these locations rods 67 are fixed at one end to the positioning plate 28 and extend horizontally through aligned holes in the mounting plates 28. The outer end portions of the rods 67 are threaded so that nuts 68 can be screwed thereon to engage the outermost plate 28 and clamp the spacer sleeves 65 between the plates 28 and **28*a* to locate the belts 30 on each plate 28 in the required positions of alignment with the rows of bottle necks. It is a relatively simple operation to adjust the lateral alignment of the plates 28 for different lateral spacings of bottle necks, by loosening the clamping nuts on rods 67, removing spacer sleeves 64 and 65, sliding the plates 28 on shafts 24 and substituting a different set of spacer sleeves 64 and 65** and again tightening the clamping nuts to clamp the plates against the spacers.

The mechanism for adjusting the heights of the plates 28 to accommodate the belts 30 to bottles of different heights is shown in FIGS. 2 and 6. Preferably, the posts 22 are telescoped within vertical tubes 70 rising out of the housing 17. Within the housing 17, the lower ends of posts 22 have vertically extending adjusting screws 71 threaded therein, and the bottoms of the screws are rotatably supported on a base plate 72. The lower end portions of the screws have sprockets 73 fixed thereon and operatively connected by a chain 74. The chain 74 may be driven by a sprocket 75 on the lower end of a vertical shaft 76, the upper end of which may be manually rotated or connected to a power drive. Rotation of shaft 76 raises or lowers the posts 22 simultaneously to accommodate the elevation of arms 28 to different heights of bottles.

It will be apparent that a simple and inexpensive bottle case unloader has been provided having individual arms carrying opposed V-belts for gripping each row of bottle necks, the arms being adjustable laterally to accommodate bottles of different diameters and vertically to accommodate bottles of different heights, and the opposed V-belts being adjustable toward and away from each other to accommodate bottle necks of different sizes and shapes.

What is claimed is:

1. In apparatus for unloading bottles from cases moving on a conveyor, the improvement comprising laterally adjustable guides on opposite sides of said conveyor for maintaining the cases in longitudinal alignment, a horizontal support shaft having one end mounted on a vertical post means located proximate said conveyor, said shaft extending laterally over said conveyor and having the other end free and unsupported, individual longitudinally disposed arms one for each row of bottles and laterally adjustably mounted on said shaft, laterally opposed V-belts movably mounted on each side of each arm for progressively engaging a row of bottle necks to carry the bottles, and laterally removable spacers between said arms to longitudinally align each pair of belts with a row of bottles whereby different spacers may be used for different lateral spacings of bottles.

2. Apparatus for unloading bottles as described in claim 1, wherein a reference plate is fixed on said support shaft in parallelism with said arms to locate the lateral position of the next adjacent arm.

3. Apparatus for unloading bottles as described in claim 2, wherein a laterally removable spacer is provided between the reference plate and said next adjacent arm.

4. Apparatus for unloading bottles as described in claim 1, wherein means is provided for simultaneously driving the V-belts on all of said arms.

5. Apparatus for unloading bottles as described in claim 1, wherein said V-belts are driven around lower rear pulleys and upper front pulleys, and a pair of longitudinal guide means on each arm between the pulleys for engaging the lower runs of the opposed V-belts with the necks of each row of bottles.

6. Apparatus for unloading bottles as described in claim 5, wherein a single drive shaft extends through all of the arms and drives the upper front pulleys thereon.

7. Apparatus for unloading bottles as described in claim 5, wherein means is provided for laterally adjusting each said pair of belt guide means toward and away from each other.

8. Apparatus for unloading bottles as described in claim 7, wherein a single drive shaft extends through all of the arms and drives the upper front pulleys thereon.

9. Apparatus for unloading bottles as described in claim 1, wherein said vertical post is extensible, and means is provided to vertically adjust the height of said post to accommodate the V-belts to different bottle heights.

10. Apparatus for unloading bottles as described in claim 9, wherein a reference plate is fixed on said support shaft in parallelism with said arms to locate the lateral position of the next adjacent arm.

* * * * *